US006218914B1

(12) United States Patent
Kubota et al.

(10) Patent No.: US 6,218,914 B1
(45) Date of Patent: Apr. 17, 2001

(54) DIELECTRIC FILTER AND DIELECTRIC DUPLEXER INCLUDING A MOVABLE PROBE

(75) Inventors: Kazuhiko Kubota, Mukou; Tomoyuki Ise, Nagaokakyo, both of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/233,521

(22) Filed: Jan. 20, 1999

(30) Foreign Application Priority Data

Jan. 20, 1998 (JP) ..... 10-008860

(51) Int. Cl.[7] ..... H01P 1/20; H01P 7/10

(52) U.S. Cl. ..... 333/202; 333/219.1; 333/134; 333/26

(58) Field of Search ..... 333/202, 219.1, 333/134, 26

(56) References Cited

U.S. PATENT DOCUMENTS 2,431,941 12/1947 Kihn ..... 333/33
4,727,342 2/1988 Ishikawa et al. ..... 333/219
4,740,764 * 4/1988 Gerlack ..... 333/26
6,016,090 * 1/2000 Iio et al. ..... 333/202

OTHER PUBLICATIONS

A. B. Bereskin: "Multi–Screw Tuner for Any Mismatch", Microwave Journal, vol. 26, No. 8, Aug. 1983, pp. 133–141.
Patent Abstracts of Japan, vol. 8, No. 70 (E–235), Apr. 3, 1984 & JP 58 218201 A, (Alps Denki KK), Dec. 19, 1983.
Patent Abstracts of Japan, vol. 15, No. 58 (E–1032), Feb. 12, 1991 & JP 02 285702 A (Matsushita Electric Ind. Co. Ltd.), Nov. 26, 1990.
European Search Report dated Apr. 22, 1999.

* cited by examiner

*Primary Examiner*—Benny Lee
*Assistant Examiner*—Stephen E. Jones
(74) *Attorney, Agent, or Firm*—Ostrolenk, Faber, Gerb & Soffen, LLP

(57) ABSTRACT

A dielectric filter includes a shielding cavity frame having electric conductivity, a dielectric having electrodes formed on two opposing faces and disposed in the shielding cavity frame, and external coupling means, wherein the external coupling means includes an electric probe at least a part of which is covered with a covering dielectric.

10 Claims, 5 Drawing Sheets

DIELECTRIC FILTER AND DIELECTRIC DUPLEXER INCLUDING A MOVABLE PROBE

BACKGROUND OF THE INVENTION

1. Field of the Invention

The present invention relates to a dielectric filter and a dielectric duplexer for use in a communication base station or the like.

2. Description of the Related Art

A dielectric filter relating to the present invention is shown in FIG. 7. Although this dielectric filter is described in copending U.S. patent application Ser. No. 924,040, now U.S. Pat. No. 6,052,041, this dielectric filter was not known yet in the art at the time when the invention, on the basis of which the priority of the present invention is claimed, was filed as Japanese Patent Application No. H-10-8860.

FIG. 7 is a perspective view of the dielectric filter 110. In this figure, an upper lid 114 is removed so that the internal structure can be seen. The dielectric filter shown herein is, by way of example, of the two-stage band-rejection filter type including two disk-shaped dielectrics 112 disposed side by side in a shielding cavity frame 111.

The dielectric filter 110 includes a shielding cavity frame 111 formed of metal, a dielectric 112 disposed in the shielding cavity frame 111, and external coupling means 120. The dielectric 112 is formed of ceramic in a disk shape and electrodes are formed of silver or the like on two opposite upper and lower surfaces thereof. The lower surface of the dielectric 112 is fixed via solder or the like to the inner bottom surface of the shielding cavity frame 111 thereby achieving electric connection. The external coupling means 120 includes an electric probe 121 made of a metal wire. The electric probe 121 is disposed in such a manner that it extends in a space between the upper surface of the dielectric 112 and the shielding cavity frame 111 without having contact with either the dielectric 112 or the shielding cavity frame 111. By employing the above structure, it becomes possible to reduce the current flowing through the shielding cavity frame 111 thereby reducing the loss due to such a current thus achieving a TM-mode dielectric filter having a small size in height and having high unloaded Q.

The electric probe 121 is connected via solder to an external connector 113 attached to the shielding cavity frame 111 so that a signal is input and output via the electric probe 121. That is, a signal is supplied via a cable connected to the external connector 113 and is passed through the electric probe 121. The electric probe 121 is coupled with the dielectric 112 via capacitance created between the electric probe 121 and the electrode of the dielectric 112. The dielectric 112 coupled with the electric probe 121 has resonance and thus serves as a band-rejection filter. The resultant signal is output through a cable connected to another external connector 113.

In the above-described dielectric filter, the coupling between the electric probe and the dielectric is realized via the capacitance between the electric probe and the dielectric. Thus, the strength of the coupling depends on the capacitance between the electric probe and the dielectric. The capacitance is determined by the distance between the electric probe and the dielectric, the areas of surfaces facing each other, and the dielectric constant of a substance existing between them. The attenuation varies with the change in the strength of the coupling, and the characteristic of the dielectric filter vary in such a manner that the filter has a band-rejection or bandpass characteristic with a wide bandwidth when the coupling is strong while the bandwidth becomes narrow when the coupling is weak. Therefore, to achieve a dielectric filter having desired characteristics, it is required to adjust the coupling between the electric probe and the dielectric. That is, it is required to adjust the capacitance between the electric probe and the dielectric.

In the above-described dielectric filter, the electric probe made of a metal wire is used as the external coupling means. The capacitance may be varied, as described above, by varying the distance between the electric probe and the dielectric, the areas of the surfaces, and/or the dielectric constant. However, it is difficult to change the location of the electric probe connected to the external connector because it is difficult to change the location of the external connector attached to the shielding cavity frame. The dielectric constant of air is impossible to change. Thus, a most practical manner of adjusting the capacitance between the electric probe and the dielectric is to change the length of the electric probe thereby changing the areas of the surfaces facing each other.

However, it is a troublesome process to adjust the length of the electric probe by cutting the electric probe for each dielectric or for each dielectric filter including the dielectric. Furthermore, if once the electric probe is cut to a too short length, it is impossible to make a readjustment to increase the capacitance.

Furthermore, an electrical discharge occurs through air existing between the electric probe and the dielectric when the potential difference between them exceeds the dielectric strength of air. Such a discharge can cause a difference in the characteristic of the electrode or the electric probe of the dielectric filter.

In view of the problems described above, it is an object of the present invention to provide a dielectric filter and dielectric duplexer whose characteristics can be more easily adjusted and which have higher reliability.

SUMMARY OF THE INVENTION

According to an aspect of the invention, to achieve the above object, there is provided a dielectric filter including a shielding cavity frame having electric conductivity, a dielectric having electrodes formed on two opposing faces and disposed in the shielding cavity frame, and external coupling means, wherein the external coupling means includes an electric probe at least a part of which is covered with a covering dielectric.

In this dielectric filter, the covering dielectric covering the electric probe is preferably movable.

The movability of the covering dielectric may be achieved by connecting the covering dielectric to the electric probe by means of mating via screw threads.

According to another aspect of the invention, there is provided a dielectric duplexer including a shielding cavity frame having electric conductivity, a dielectric having electrodes formed on two opposing faces and disposed in the shielding cavity frame, external coupling means, input/output connection means and antenna connection means connected to the coupling means, wherein the external coupling means includes an electric probe at least a part of which is covered with a covering dielectric.

In this dielectric duplexer, the covering dielectric covering the electric probe is preferably movable.

The movability of the covering dielectric may be achieved by connecting the covering dielectric to the electric probe by means of mating via screw threads.

In the above-described dielectric filter and the dielectric duplexer according to the invention, it is possible to easily adjust the capacitance between the electric probe and the dielectric. Furthermore, it is possible to increase the dielectric strength between the electric probe and the dielectric.

DESCRIPTION OF THE PREFERRED EMBODIMENTS

Figure 1:
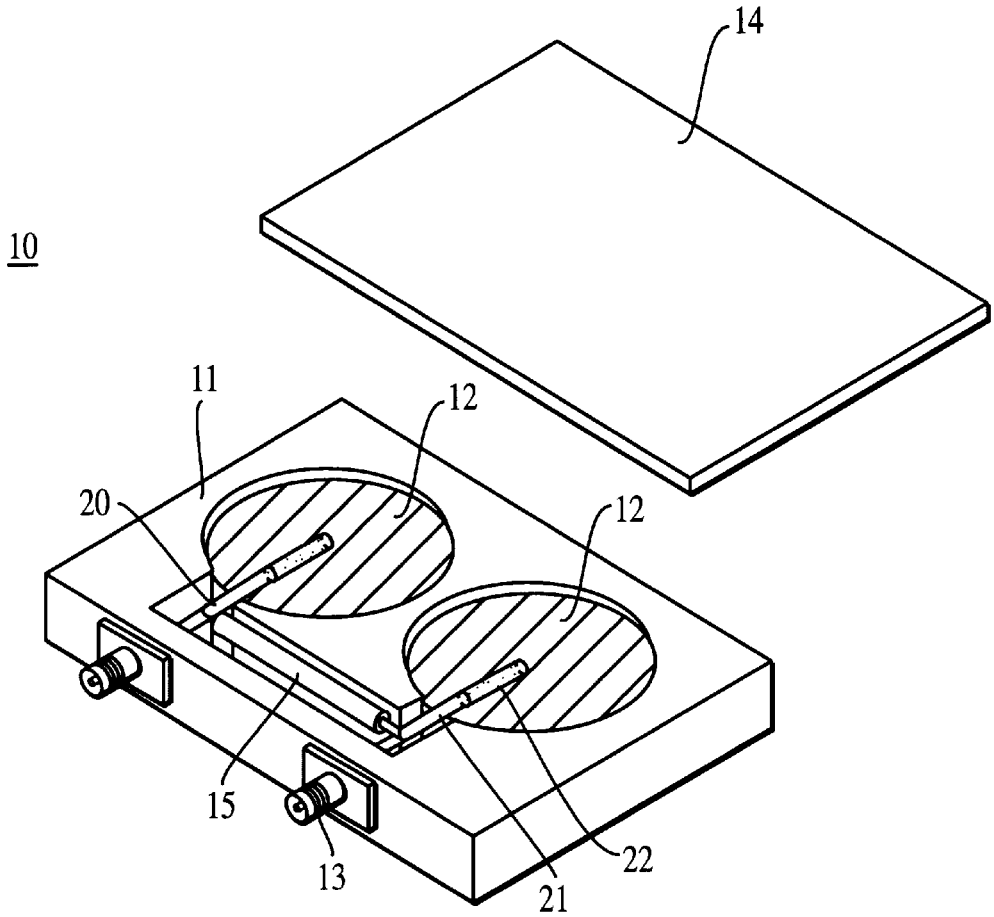
FIG. 1 is a perspective view of a dielectric filter according to the present invention.

Referring now to FIG. 1, an embodiment of a dielectric filter according to the present invention is described below. FIG. 1 is a perspective view of the dielectric filter 10 according to the present invention. In the figure, an upper lid 14 is removed so that the internal structure can be seen.

The dielectric filter 10 includes a shielding cavity frame 11, disk-shaped dielectrics 12, and external coupling means 20. The shielding cavity frame 11 is formed of metal and external connectors 13 are attached to it so that a signal is input and output from and to the outside via cables. The external coupling means 20 are connected to the respective external connectors 13 via solder. Each dielectric 12 is formed of ceramic in a disk shape and electrodes are formed on it by means of coating and baking silver paste on two opposing surfaces. The lower surface of each dielectric 12 is fixed via solder or the like to the inner bottom face of the shielding cavity frame 11 thereby achieving electric connection. Alternatively, the dielectric 12 may be soldered to a ground plate or the like and may be placed in the shielding cavity frame 11. In this embodiment, two dielectrics 12 are placed side by side and these two dielectrics 12 are connected to each other via a ¼-transmission line 15 so that the dielectric filter 10 acts as a two-stage band-rejection filter. The shielding cavity frame 11 may also be produced by forming an electrically conductive layer on the surface of a ceramic material. The dielectric 12 may also be formed into a square shape. The electrodes on the two opposing surfaces of the dielectric 12 may be formed into the structure of a multilayer thin film so as to reduce the loss.

Figure 2:
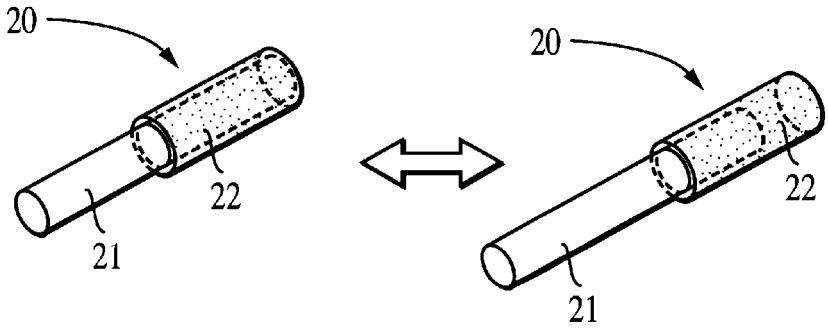
FIG. 2 is a perspective view of external coupling means according to the present invention.

The external coupling means 20 includes an electric probe 21 made up of a metal wire a desired part of which is covered with a resin or the like 22 serving as a covering dielectric. As for the resin 22, polyprene or a similar resin is employed which can be easily formed into a desired shape and which has elasticity which makes it easy to perform the adjustment which will be described later. The resin 22 is formed into the shape of a cylinder with a diameter greater than the diameter of the electric probe 21 wherein a through-hole is formed such that it extends from one end of the cylinder to the opposite end or a semi-through-hole is formed such that one end of the semi-through-hole is closed with one end of the cylinder. The electric probe 21 is inserted into this hole and the resin 22 is moved to a desired position so that a desired part of the electric probe 21 is covered with the resin 22 as shown in FIG. 2. Thus, the resin 22 is present between the electric probe 21 and the dielectric 12. The resin 22 has a higher dielectric strength and a greater dielectric constant than air. Therefore, covering the electric probe 21 with the resin 22 results in a reduction in the probability that a discharge will occur between the electric probe 21 and the dielectric 12. Furthermore, the capacitance can be varied by varying the dielectric constant between the electric probe 21 and the dielectric 12 using the resin 22. More specifically, by varying the relative length of the part of the electric probe 21 inserted in the resin 22, it is possible to vary the capacitance and thus the strength of the coupling between the electric probe 21 and the dielectric 12. Thus it becomes possible to make an adjustment to obtain desired band characteristics.

Figure 3:
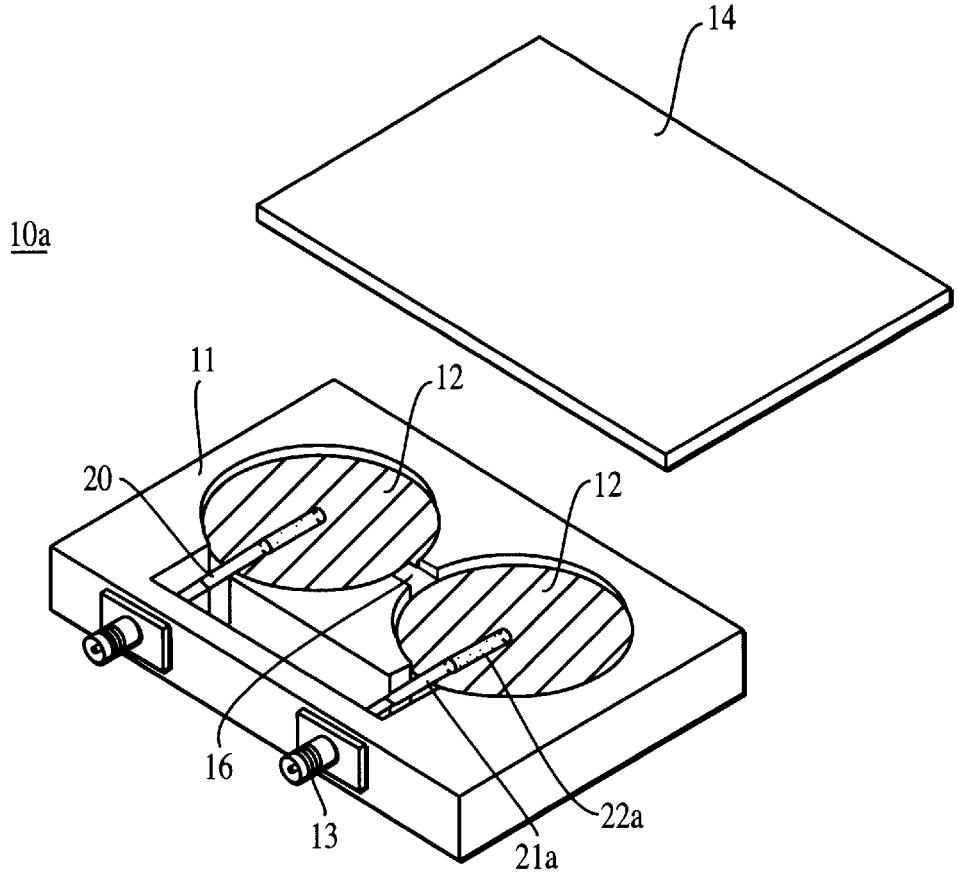
FIG. 3 is a perspective view of a second embodiment of a dielectric filter according to the present invention.
Figure 4:
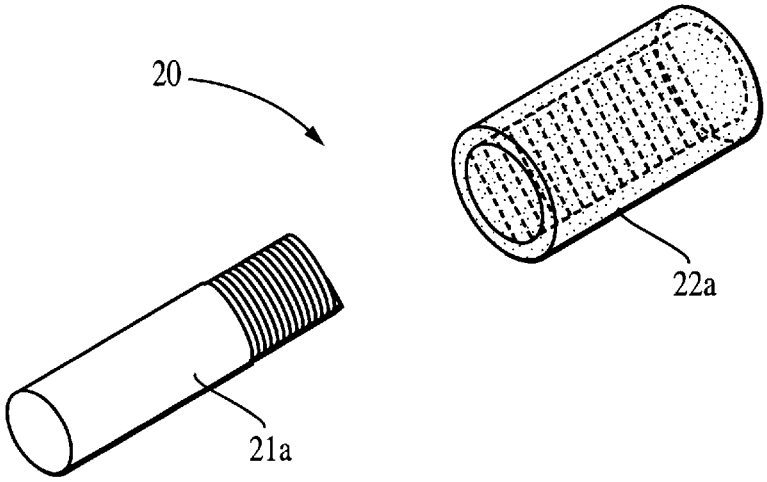
FIG. 4 is a perspective view of external coupling means of the second embodiment according to the present invention.

Referring now to FIGS. 3 and 4, a second embodiment of the present invention is described below. Similar parts to those in the previous embodiment are denoted by similar reference numerals and they are not described in further detail herein.

As illustrated in FIG. 3, the dielectric filter of the present embodiment includes two disk-shaped dielectrics 12 each having electrodes formed on two opposing surfaces and disposed side by side in a shielding cavity frame 11. The two dielectrics 12 are coupled to each other via a capacitive coupling member 16. The dielectric filter 10*a* having the structure described above acts as a two-stage bandpass filter.

FIG. 4 is a perspective view illustrating an electric probe 21*a* made up of a metal wire and also illustrating a resin 22*a* covering the electric probe 21*a*, according to the present embodiment. As shown in FIG. 4, the electric probe 21*a* and the resin 22*a* are threaded such that the electric probe 21*a* serves as a male screw and the resin 22*a* acts as a female screw. The resin 22*a* is screwed onto the electric probe 21*a* thereby connecting them to each other. This allows the resin 22*a* to be easily connected to the electric probe 21*a* in a firm fashion so that the resin 22*a* is not moved by external vibrations or a mechanical shock. That is, the strength of the coupling between the electric probe 21*a* and the dielectric 12 is not changed by an external disturbance.

Figure 5:
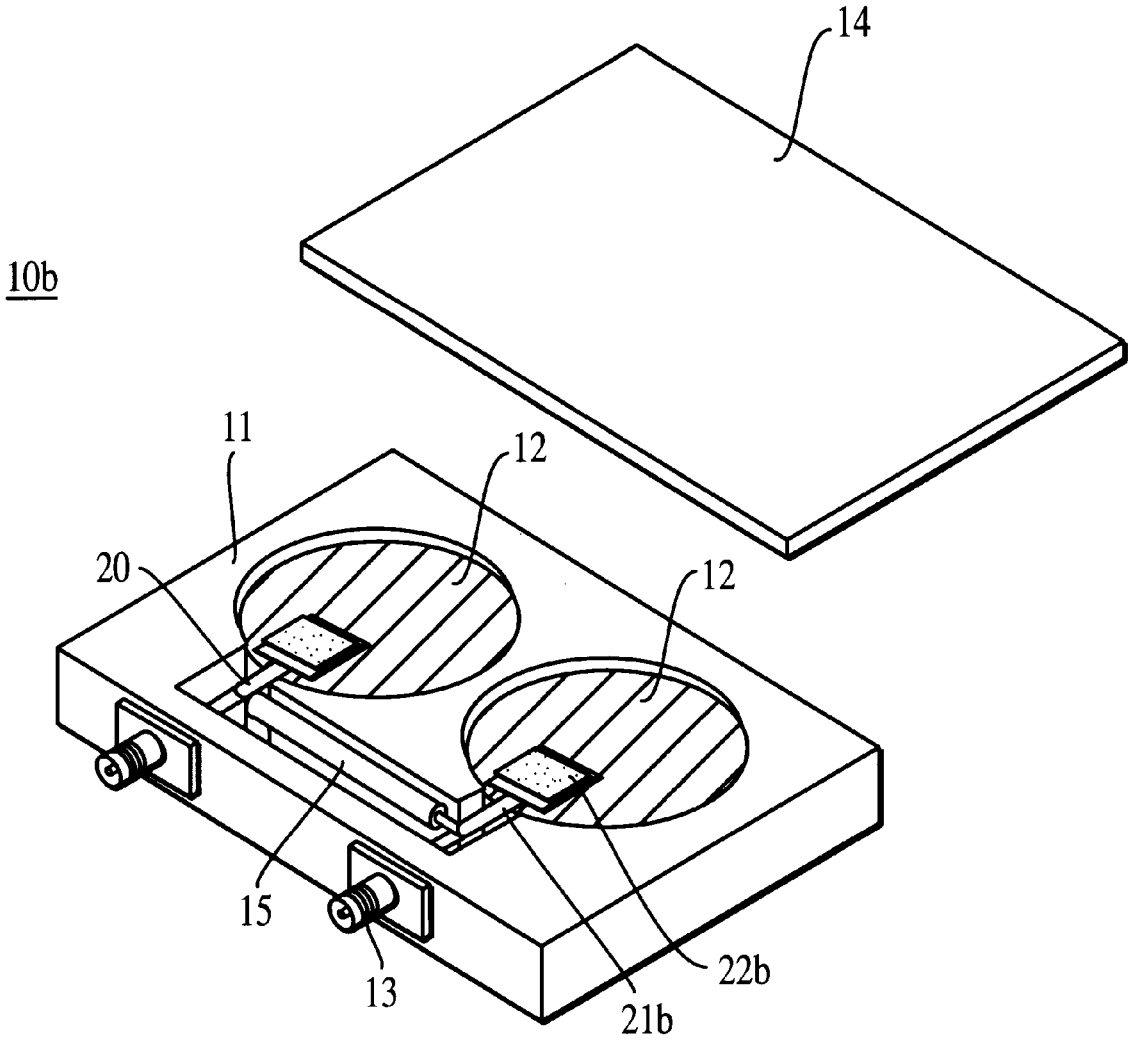
FIG. 5 is a perspective view of a third embodiment of a dielectric filter according to the present invention.

Referring now to FIG. 5, a third embodiment of the present invention is described below. Also in this figure, an upper lid 14 is removed so that the internal structure of a dielectric filter 10*b* can be seen. As in the first embodiment, two disk-shaped dielectrics 12 are connected to each other via a /4-transmission line 15 so that the dielectric filter 10*b* acts as a two-stage band-rejection filter. Similar parts to those in the previous embodiments are denoted by similar reference numerals and they are not described in further detail herein.

In the present embodiment, each external coupling means 20 includes an electric probe 21*b* made up of a metal wire a desired part of which is covered with a resin or the like 22*b* serving as a covering dielectric. As for the resin 22*b*, polyprene or a similar resin is employed which can be easily formed into a desired shape and which has elasticity which makes it easy to perform the adjustment which will be described later. This resin 22*b* has a hole corresponding to the electric probe 21*b*. The electric probe 21*b* is inserted into the hole and the resin 22*b* is moved to a desired position so that a desired part of the electric probe 21*b* is covered with the resin 22*b*. Thus, the resin 22*b* is present between the electric probe 21*b* and the dielectric 12. The resin 22*b* has a higher dielectric strength and a greater dielectric constant than air. Therefore, covering each electric probe 21*b* with the resin 22*b* results in a reduction in the probability that a discharge will occur between the electric probe 21*b* and the dielectric 12. Furthermore, the capacitance can be varied by varying the dielectric constant between the electric probe 21*b* and the dielectric 12 using the resin 22*b*. More specifically, by varying the relative length of the part of the electric probe 21*b* inserted in the resin 22*b*, it is possible to vary the capacitance and thus the strength of the coupling between the electric probe 21*b* and the dielectric 12. Thus, it is possible to make an adjustment such that the dielectric filter has desired characteristics. Because the external coupling means 20 is formed into the shape of a plate, it is easier to obtain desired capacitance than in the first embodiment.

Figure 6:
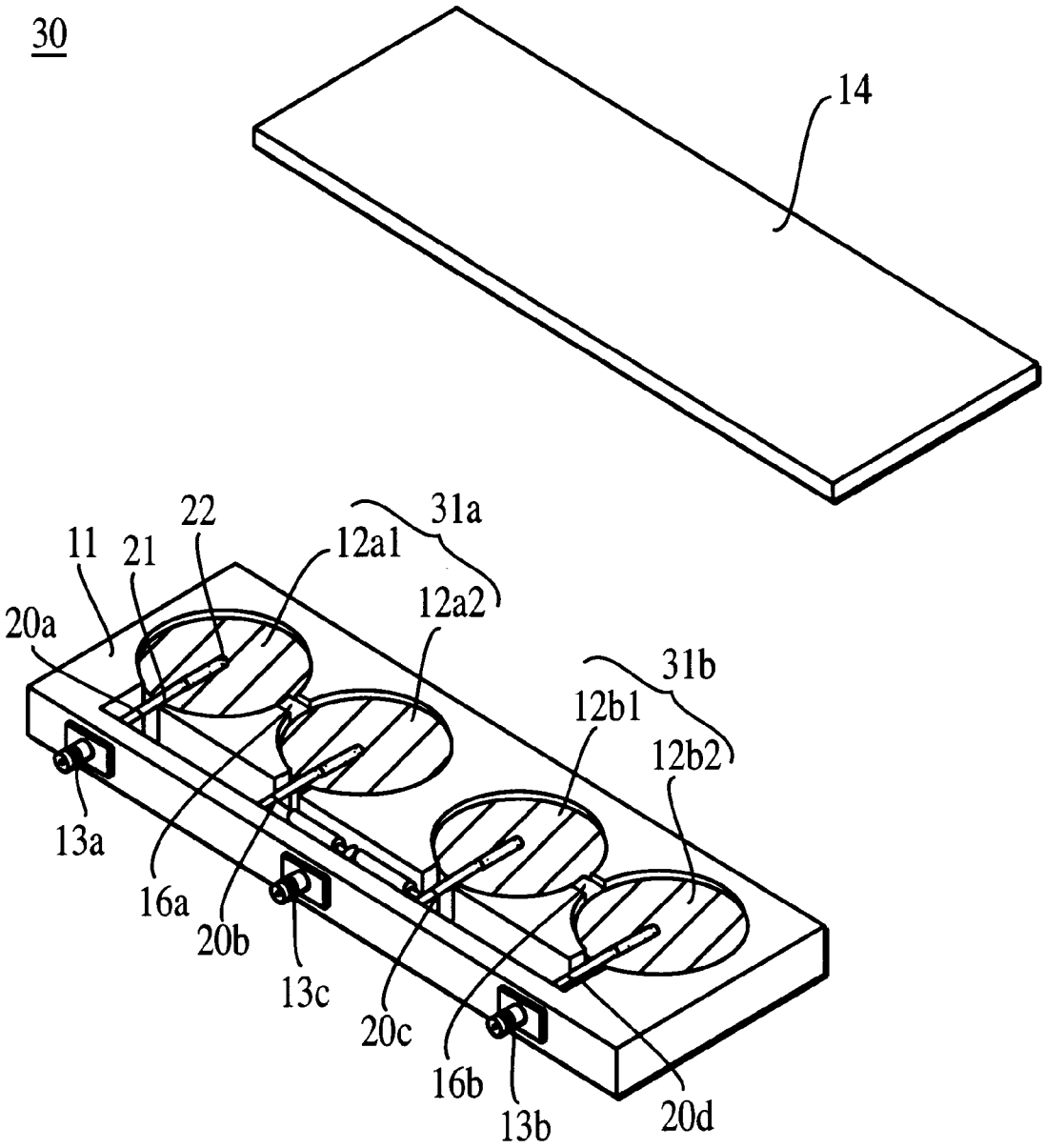
FIG. 6 is a perspective view of a dielectric duplexer according to the present invention.
Figure 7:
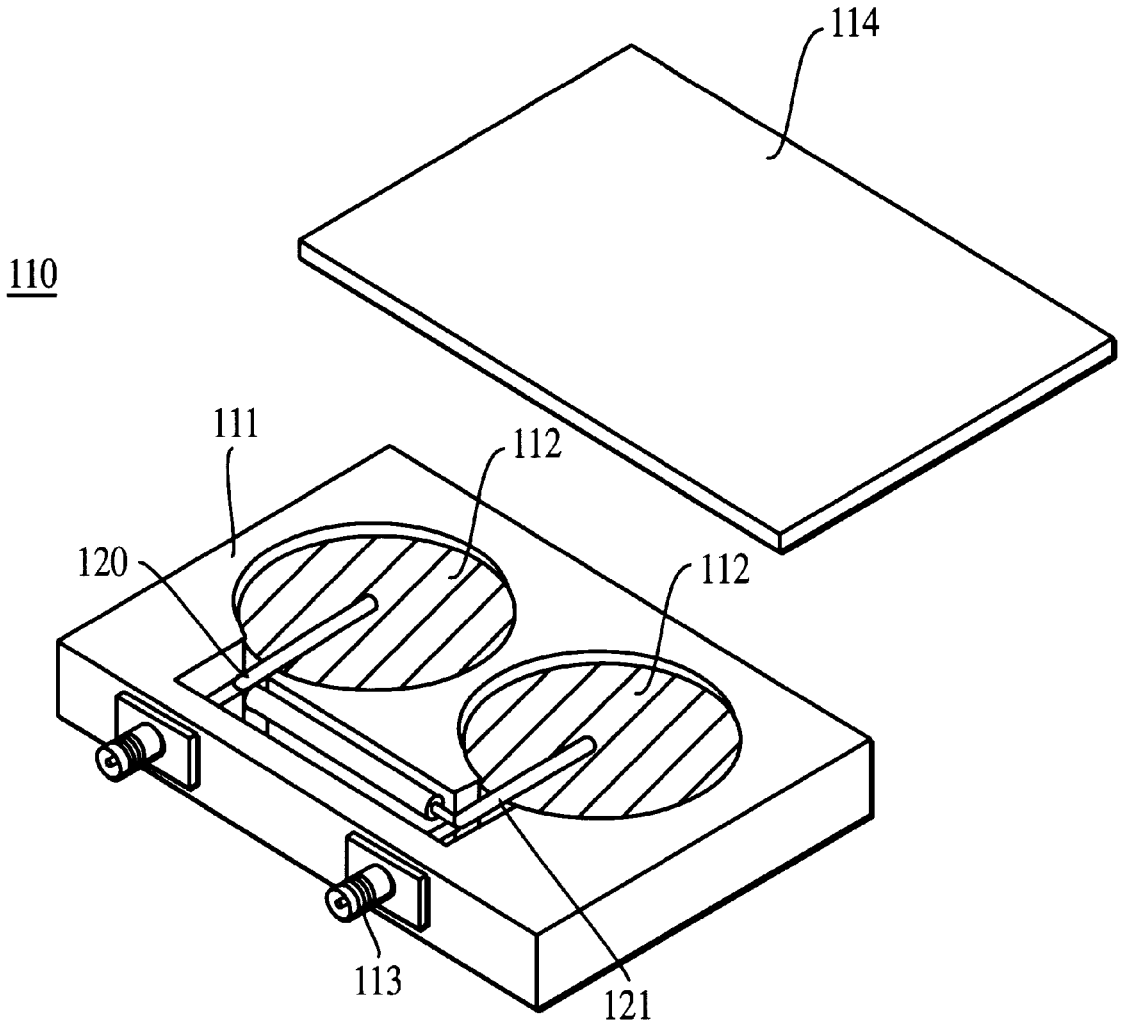
FIG. 7 is a perspective view of an another type of dielectric filter.

Referring to FIG. 6, an embodiment of a dielectric duplexer according to the present invention is described below. Similar parts to those in the previous embodiments are denoted by similar reference numerals and they are not described in further detail herein.

As illustrated in FIG. 6, a dielectric duplexer 30 includes a first dielectric filter 31*a* and a second dielectric filter 31*b* wherein the first dielectric filter 31 includes two disk-shaped dielectrics 12*a*1 and 12*a*2 disposed in a shielding cavity frame 11 and the second dielectric filter 31 includes two disk-shaped dielectrics 12*b*1 and 12*b*2. The two dielectrics 12*a*1 and 12*a*2 of the first dielectric filter 31*a* are coupled to each other via a capacitive coupling member 16*a* so that the first dielectric filter 31*a* serves as a transmitting bandpass filter. The two dielectrics 12*b*1 and 12*b*2 of the second dielectric filter 31*a* have resonant frequencies different from those of the dielectrics 12*a*1 and 12*a*2 of the first dielectric filter 31*a* and are coupled to each other via a capacitive coupling member 16*b* so that the second dielectric filter 31*b* serves as a receiving bandpass filter. The external coupling means 20*a* coupled with the dielectric 12*a*1 of the first dielectric filter 31*a* is connected to an external connector 13*a* which is connected to an external transmitting circuit. The external coupling means 20*d* coupled with the dielectric 12*b*2 of the second dielectric filter 31*b* is connected to an external connector 13*b* which is connected to an external receiving circuit. The external coupling means 20*b* coupled with the dielectric 12*a*2 of the first dielectric filter 31*a* and the external coupling means 20*c* coupled with the dielectric 12*b*1 of the second dielectric filter 31*b* are connected to an external connector 13*c* which is connected to an external antenna.

The external coupling means 20*a*, 20*b*, 20*c*, and 20*d* each include an electric probe 21 made up of a metal wire a desired part of which is covered with a resin or the like 22 serving as a covering dielectric. By covering the electric probes 21 with resins 22, it becomes possible to reduce the probability that a discharge will occur between the electric probes 21 and the dielectrics 12*a*1, 12*a*2, 12*b*1, and 12*b*2. Furthermore, the capacitance can be varied by varying the dielectric constant between the electric probe 21*s* and the dielectrics 12*a*1, 12*a*2, 12*b*1, and 12*b*2, using the resins 22. More specifically, by varying the relative length of the part of the electric probes 21 inserted in the resins 22, it is possible to vary the capacitance and thus the strength of the coupling between the electric probes 21 and the dielectrics 12*a*1, 12*a*2, 12*b*1, and 12*b*2. Thus it becomes possible to make an adjustment to obtain desired band characteristics.

As described above, the present invention has various advantages. That is, in the present invention, the electric probe made of metal and serving as the external coupling means in the dielectric filter or dielectric duplexer is covered with the covering dielectric thereby increasing the dielectric strength between the electric probe and the dielectric thus reducing the probability that a discharge will occur.

The covering dielectric on the electric probe is provided in a movable fashion whereby the part of the electric probe covered with the covering dielectric can be varied. This makes it possible to easily adjust the strength of the coupling between the electric probe and the dielectric without having to cut each electric probe to a shorter length. That is, by varying the coupling strength, it is possible to make an adjustment such that the pass band or the rejection band of the dielectric filter or the dielectric duplexer has a greater or smaller bandwidth as required. Thus, it is possible to easily produce dielectric filters and dielectric duplexers having desired characteristics depending on applications in which they are used.

Furthermore, by connecting the covering dielectric to the electric probe by means of mating via screw threads, it becomes possible to prevent the length of the part of the electric probe covered with the covering dielectric from varying after completion of the characteristic adjustment. That is, after adjusting the characteristics of the dielectric filter, the position of the covering dielectric on the electric probe is not varied by an external shock or vibrations. Thus, it is possible to prevent the dielectric filter and the dielectric duplexer from having a change in characteristics due to an external disturbance.

As described above, the present invention provides a dielectric filter and a dielectric duplexer whose characteristics can be easily adjusted and which have good long-term reliability.

What is claimed is:

1. A dielectric filter including a shielding cavity frame having electric conductivity, a dielectric having electrodes formed on opposing faces and disposed in said shielding cavity frame, and an external coupling, said dielectric filter being characterized in that said external coupling includes an electric probe at least a part of which is covered with a covering dielectric which adjusts a capacitive coupling between said electric probe and said dielectric of said filter.

2. A dielectric filter according to claim 1, wherein only a part of said electric probe is covered with said covering dielectric.

3. A dielectric filter according to claim 1, wherein said covering dielectric comprises polyprene resin.

4. A dielectric filter including a shielding cavity frame having electric conductivity, a dielectric having electrodes formed on opposing faces and disposed in said shielding cavity frame, and an external coupling, said dielectric filter being characterized in that said external coupling includes an electric probe at least a part of which is covered with a covering dielectric; wherein the covering dielectric covering said electric probe is movable.

5. A dielectric filter according to claim 4, wherein the movability of said covering dielectric is achieved by connecting said covering dielectric to said electric probe via mating screw threads.

6. A dielectric duplexer including a shielding cavity frame having electric conductivity; a dielectric having electrodes formed on two opposing faces and disposed in said shielding cavity frame, an external coupling, an input/output connection and an antenna connection connected to said external coupling, said dielectric duplexer being characterized in that said external coupling includes an electric probe at least a part of which is covered with a covering dielectric which adjusts a capacitive coupling between said electric probe and said dielectric of said duplexer.

7. A dielectric duplexer according to claim 6, wherein only a part of said electric probe is covered with said covering dielectric.

8. A dielectric duplexer according to claim 6, wherein said covering dielectric comprises polyprene resin.

9. A dielectric duplexer including a shielding cavity frame having electric conductivity; a dielectric having electrodes formed on two opposing faces and disposed in said shielding cavity frame, an external coupling, an input/output connection and an antenna connection connected to said external coupling, said dielectric duplexer being characterized in that said external coupling includes an electric probe at least a part of which is covered with a covering dielectric wherein the covering dielectric covering said electric probe is movable.

10. A dielectric duplexer according to claim 9, wherein the movability of said covering dielectric is achieved by connecting said covering dielectric to said electric probe via mating screw threads.

* * * * *